United States Patent [19]

Doroftei et al.

[11] Patent Number: 5,041,767

[45] Date of Patent: Aug. 20, 1991

[54] DIGITAL CONTROLLER FOR GAS DISCHARGE TUBE

[75] Inventors: Mihail Doroftei; Pat Arotta; Brian D. Green; Rastislav N. Royko; Brent M. Serbin, all of Calgary, Canada

[73] Assignee: Bertonee Inc., Calgary, Canada

[21] Appl. No.: 501,735

[22] Filed: Mar. 30, 1990

[51] Int. Cl.[5] ..... H05B 41/36

[52] U.S. Cl. ..... 315/292; 315/224; 315/293; 315/307; 315/DIG. 7

[58] Field of Search ..... 315/292, 293, DIG. 7, 315/307, 224, 287

[56] References Cited

U.S. PATENT DOCUMENTS

| | | | |
|---|---|---|---|
| 2,708,251 | 5/1955 | Rively | 315/183 |
| 3,050,654 | 8/1962 | Toulon | 313/108 |
| 3,059,149 | 10/1962 | Salisbury | 315/267 |
| 3,196,312 | 7/1965 | Marrison | 315/171 |
| 3,767,970 | 10/1973 | Collins | 315/241 R |
| 3,882,356 | 5/1975 | Stehlin | 315/205 |
| 3,883,778 | 5/1975 | Kaji et al. | 315/205 |
| 3,990,000 | 11/1976 | Digneffe | 315/292 X |
| 4,005,330 | 1/1977 | Glascock, Jr. et al. | 315/57 |
| 4,047,077 | 9/1977 | Veith | 315/169 TV |
| 4,048,541 | 9/1977 | Adams et al. | 315/248 |
| 4,158,793 | 6/1979 | Lewis | 315/101 |
| 4,168,453 | 9/1979 | Gerhard et al. | 315/DIG. 7 X |
| 4,219,760 | 8/1980 | Ferro | 315/248 |
| 4,230,971 | 10/1980 | Gerhard et al. | 315/307 |
| 4,238,710 | 12/1980 | Nelson | 315/307 |
| 4,253,046 | 2/1981 | Gerhard et al. | 315/DIG. 7 X |
| 4,266,165 | 5/1981 | Handler | 315/DIG. 7 X |
| 4,376,912 | 3/1983 | Jernakoff | 315/248 |
| 4,475,064 | 10/1984 | Burgess | 315/227 R |
| 4,511,195 | 4/1985 | Barter | 315/307 X |
| 4,612,479 | 9/1986 | Zansky | 315/194 |
| 4,631,449 | 12/1986 | Peters, Jr. | 315/205 |
| 4,663,570 | 5/1987 | Luchaco et al. | 315/307 X |
| 4,682,084 | 7/1987 | Kuhnel et al. | 315/307 |
| 4,700,111 | 10/1987 | Folwell et al. | 315/200 R |
| 4,742,278 | 5/1988 | Iannini | 315/248 |
| 4,748,383 | 5/1988 | Houkes | 315/248 |
| 4,751,434 | 6/1988 | Helling et al. | 315/183 |
| 4,766,350 | 8/1988 | Husgen et al. | 315/207 |
| 4,766,351 | 8/1988 | Hull et al. | 315/240 |
| 4,792,725 | 12/1988 | Levy et al. | 315/39 |
| 4,792,727 | 12/1988 | Godyak | 315/176 |

*Primary Examiner*—Eugene R. LaRoche
*Assistant Examiner*—Do Hyun Yoo
*Attorney, Agent, or Firm*—Lewis H. Eslinger; Jay H. Maioli

[57] ABSTRACT

A gas discharge tube is controlled in intensity and in the length along such tube that is illuminated by providing digital control signals to an analog drive circuit connected to the high-voltage energization device for the tube. A pulse-width modulated digital control signal containing illumination length and intensity information is converted to ramp-shaped analog drive pulse that control the voltage at a high-voltage transformer secondary to which the gas discharge tube is connected. A manually actuatable keypad permits the user to enter the information that is then converted to the pulse-width modulated signal.

10 Claims, 4 Drawing Sheets

DIGITAL CONTROLLER FOR GAS DISCHARGE TUBE

BACKGROUND OF THE INVENTION

1. Field of the Invention

This invention relates generally to a method and apparatus for controlling the operation of a gas discharge tube and, more particularly, to a method and apparatus for digitally controlling the length along the tube that is illuminated and the light intensity of a cold cathode gas discharge tube using a pulse-width modluated signal.

2. Description of the Background

Lighting devices that provide illumination by means other than incandescence are well-known and extremely common. Among such lighting devices are ionizable gas tubes that contain neon, argon and the like which are generally known as gas discharge tubes. In these devices the light is produced on the basis of excitation of an ionizable gas contained within a tube.

A large number of different approaches to exciting the gas in the tube are known, however, all have a common principle of applying a high, alternating current (AC) potential between two electrodes of the tube, or a variation in which the high voltage AC is applied to one electrode of the tube, with the other electrode being connected to ground. This AC high voltage causes a small current to flow through the gas inside the tube, thereby ionizing the gas and producing a plasma that ultimately releases energy in the form of visible light.

So-called fluorescent lights are fired or operated by maintaining a cathode heater voltage to provide electron emission, thereby helping ionization of the gas. A variation of such approach is the so-called cold cathode gas discharge tube, which can be started/operated using circuitry that provides a high current at the starting time and then drops the current across a ballast during operation.

Gas discharge tubes are generally thought to provide the best illumination when excited by a high voltage in the range of 5–10 kilovolts, which alternates at a frequency of at least 20 KHz. Typically, the necessary high-voltage potential is provided by a free running oscillator operating at around 20 KHz, which is then connected to the primary side of a high-voltage transformer.

There have been previously proposed various approaches to controlling the length of illumination of the tube and/or the brightness of illumination of the tube, all of which generally involve an analog circuit that controls the current flowing through the primary winding of a high-voltage transformer. These circuits have proven to be less than acceptable, both operationally and commercially, because of their complete dependence on component tolerances that are adversely affected by degradation and aging, thereby providing poor repeatability and instability of the circuitry, as well as involving an inherently high power consumption.

As noted, it is known that a relationship exists between the length of illumination along the tube and brightness of the illuminated tube relative to the potential applied to such gas-filled tube. For example, as the electrostatic potential is increased across the gas tube, a certain voltage level is reached at which the gas starts to ionize. At that instant, only a small portion of the tube in the vicinity of the high-voltage electrode will be illuminated. As the voltage is further increased, more and more of the length of the tube is progressively illuminated until the plasma, caused by the ionized gas in the tube, reaches the opposite end of the tube at which the other electrode is arranged. At that time, the entire length of the tube is illuminated and additional increases in voltage will produce corresponding increases in the light output intensity.

A variation on this principle is disclosed in U.S. Pat. No. 4,742,278 in which a cold cathode gas discharge tube includes a power source connected to only a single cathode element. The power source provides an AC voltage referenced to ground having a high enough frequency to ionize the gas through the natural surrounding capacitance between the ionized gas and the ground potential. The power source output is a ramp voltage that increases to move the ionization point along the tube from one end to the other. By controlling the ramp level, the ionization point along the length of the tube and, thus, the length of illumination can be controlled and special lighting effects can be achieved. A retrace or flyback period is provided after each ramp during which the voltage drops to zero and then commences the ramp again. This above-identified patent further discloses that a display driver unit could be responsive to various external functions, such as an audio signal, to create different display patterns using cold-cathode, gas discharge tubes. The system described in the above identified patent suffers from the same drawbacks as described above in that the system is highly dependent upon tolerances and degradation/aging of regulation elements, such as potentiometers, capacitors and the like, resulting in poor reliability, instability, and high power dissipation.

OBJECTS AND SUMMARY OF THE INVENTION

Accordingly, it is an object of the present invention to provide a method and apparatus for controlling a gas discharge tube that can eliminate the above-noted defects inherent in the devices known heretofore.

Another object of this invention is to provide an improved method and apparatus for controlling the illumination of a gas discharge tube by providing a digital control of such tube, with an analog control loop being responsive to digital signals that are controllable by the user.

In accordance with an aspect of the present invention, pulse width modulated (PWM) signals are provided to control an analog section of high-voltage generating circuitry. Such digital signals are then converted to current ramps flowing through the primary of a flyback transformer, whereby control of the current flow causes increased intensity and/or control of the length of illumination along the gas discharge tube, because the peak secondary voltage is responsive to such current ramps. By permitting the analog section to be digitally controlled, the present invention accepts the use of digital input devices, such as a conventional keypad or random access memory (RAM), thereby controlling the length of illumination and intensity of such gas discharge tube.

In another aspect of the present invention, control pulses are generated using digital techniques, which have many advantages over analog ones. Some of which are simple selection of a desired value, perfect reproducibility, and noise immunity even in the present of process and environmental variables. Using such digital control, the present invention provides a precise stop point for an illuminated portion of a tube, provides ease in setting the speed and timing of individual operating modes, reduces the effects of component aging, and provides reliable communication. The digital control signals are readily generated using, for example, a micro-controller, a sequencer, a micro-computer, or the like and can be pulse width modulated prior to application to the analog control section.

The above and other objects, features and advantages of the present invention will become apparent from the following detailed description of illustrative embodiments to be read in conjunction with the accompanying drawings, in which like reference numerals represents the same or similar elements.

DETAILED DESCRIPTION OF PREFERRED EMBODIMENTS

According to the present invention, the inventive gas discharge tube controller operates using two key techniques. First, a digitally controlled pulse width modulated drive waveform is generated in order to permit rapid and easy control of the gas discharge tube by the user and, second, this pulse-width modulated waveform is used to condition an analog driver circuit in order to control the illuminated length of the tube and/or the output intensity of the ionizable gas tube.

In generating the pulse-width modulated waveforms, a pulse train that contains pulses spaced at regular intervals is modulated so that the pulse duration or duty cycle of the waveform will be proportional to the desired length of illumination or output intensity of the tube. Various approaches to generating a pulse-width modulated signal are well-known and all of such approaches may be utilized according to the present invention. The important thing being that by utilizing pulse-width modulation there is a high precision in the control of the length of illumination or output intensity of the gas tube.

Thus, in the present invention, a pulse-width modulated signal provides the control signal that is applied to the analog drive section of the high-voltage generating circuit.

Figure 1:
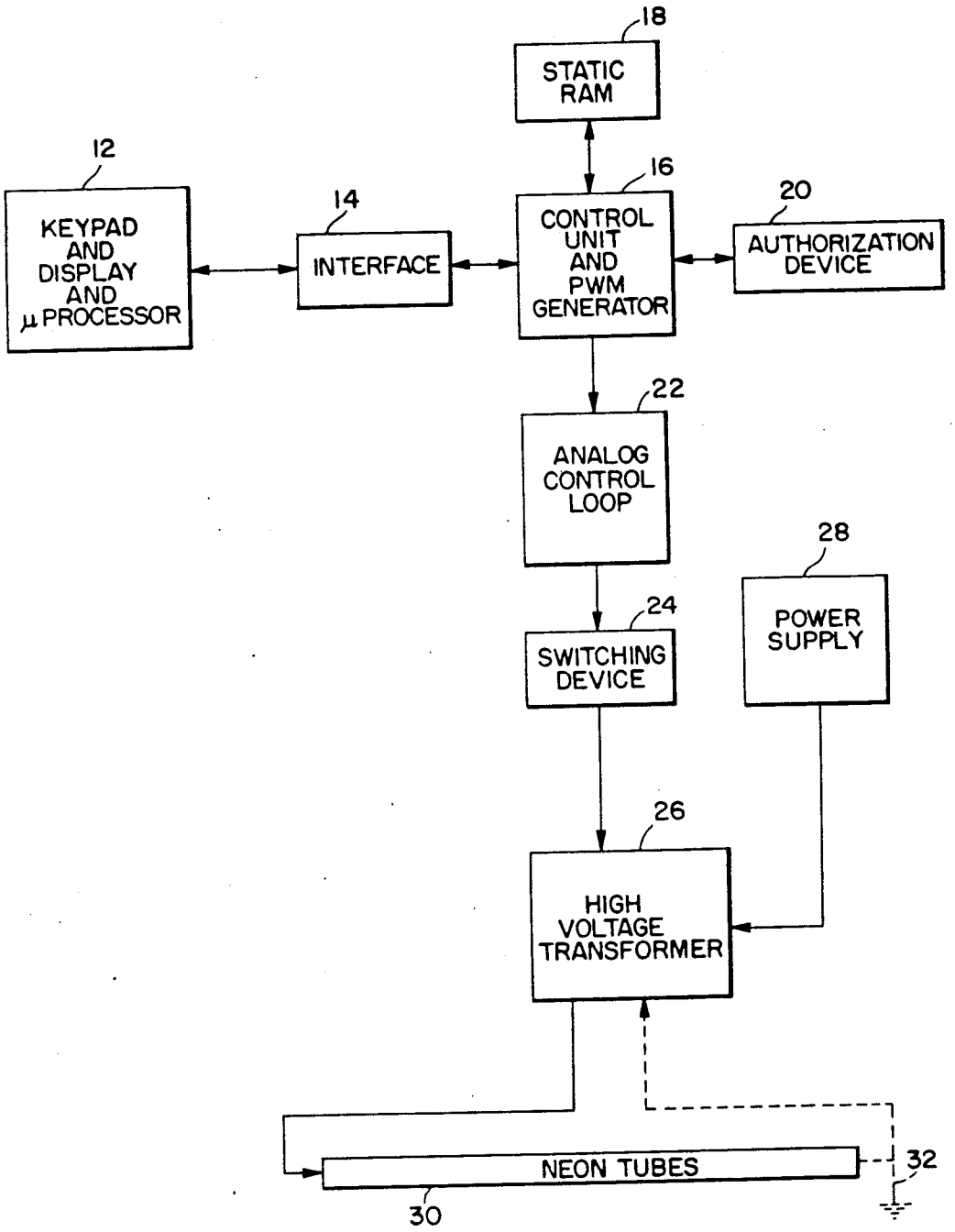
FIG. 1 is a schematic in block diagram form of a gas discharge tube control system according to an embodiment of the present invention.

FIG. 1 shows an overall gas discharge tube control system according to an embodiment of the present invention, whereby different lighting effects can be accomplished by using pulse-width modulation and digital control. According to the present invention, the user can create a complex program composed of several steps of sequencing and timing information to obtain special lighting effects, which sequence and timings could not be accomplished utilizing conventional analog control techniques.

In FIG. 1, a keypad unit 12 that includes manually operable keys for the user is provided to permit the user to digitally control the remaining portion of the gas discharge tube controller system. Keypad unit 12 contains a keyboard, as well as a display, which may be a liquid crystal display, a microprocessor and an internal control program, for example. This microprocessor with the control program will permit the user to specify, using the keyboard, the lighting effects and sequencing order as desired. The use and implementation of a keyboard and microprocessor is done in the well-known manner. The user is provided with a display of the operation of a system, as well as a display of information being entered using a keyboard. Keypad unit 12 is connected through an interface unit 14 to a control unit !6 that incorporates a pulse-width modulator. The programming information or sequential and intensity information entered by keypad unit 12 through interface 14 is also fed through the control unit 16 to a random access memory 18 where it may be stored. Random access memory 18 preferably is the kind that includes a battery back-up so that in a power-down situation, the information previously entered using keypad unit 12 is not lost. Control unit 16 may be arranged to operate in conjunction with a programmable authorization device 20 of the fuse-programmable type, which provides security in controlling the operation of the various lighting effects available.

Accordingly, control unit 16 operating in conjunction with keypad 12 and random access memory 18 provides the user with the capability to enter lighting information and sequencing that may be stored in random access memory 18 and ultimately provided as control signals in the form of a pulse-width modulated signal.

Such pulse-width modulated signal is fed from control unit 16 to an analog control loop that controls ramp current signals in response to pulse-width modulated signals. These current ramp signals are fed to a switching device 24 that is utilized to control the current flow in the primary of a high-voltage transformer 26. A power supply of the conventional kind 28 is provided for high-voltage transformer 26, whose secondary is connected to drive the appropriate gas discharge tube 30. The output at the secondary of high-voltage transformer 26 is connected to one electrode at one end of gas discharge tube 30 and the electrode at the other end can either be connected to the other side of the high-voltage transformer secondary or may be connected directly to ground, when operating according to the principles described above in U.S. Pat. No. 4,742,278. The two alternative tube electrode connections are shown at 32 by the broken lines.

Figure 2:
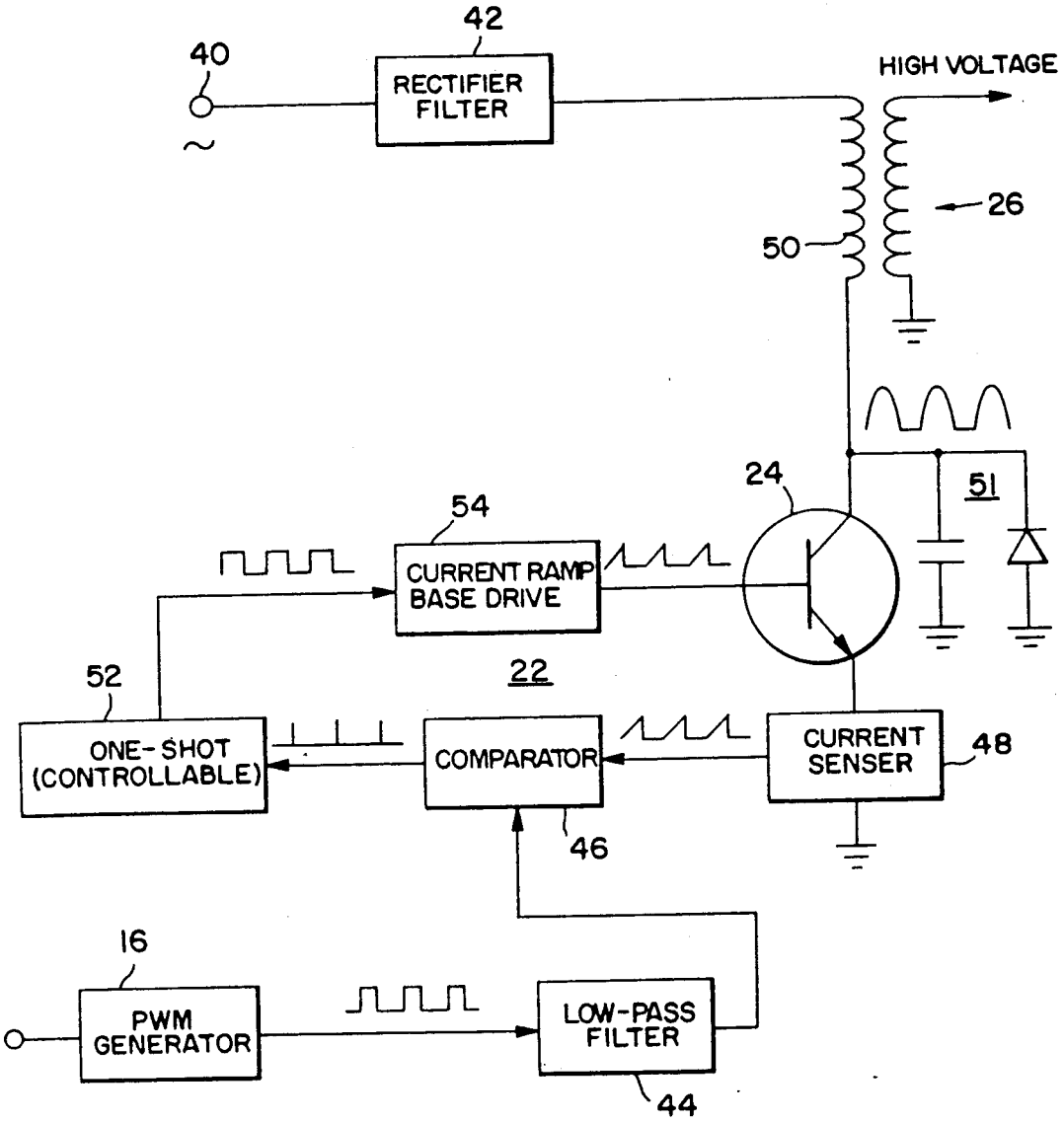
FIG. 2 is a schematic diagram showing a portion of the system of FIG. 1 in more detail.

Certain important portions of the overall operating circuit of FIG. 1 are shown in more detail in FIG. 2, in which it is shown that high-voltage transformer 26 is connected to a conventional source of AC power at input 40 and a rectifier/filter system 42, whose output is connected to transformer 26. Thus, it is seen that the AC power input and rectifier filter 42 comprise the power supply 28 of FIG. 1.

The pulse-width modulated waveform that is modulated in accordance with the instructions or information input by keypad unit 12 of FIG. 1 is used to control the analog circuit and is fed in as a pulse-width modulated square-wave signal to a low-pass filter 44. Low-pass filter 44 produces a DC voltage having a varying level that corresponds to the widths of the incoming pulses. Low-pass filter 44 may be thought of as operating as a digital-to-analog converter. The output of low-pass filter 44 is fed to a comparator circuit 46 that is used to relate this control signal to the actual voltage being generated across a current sensor element 48. Current sensor 4 may simply be a resistor with the voltage across such resistor being directly proportional to the current flowing through the primary winding 50 of high-voltage flyback transformer 26. Half-wave rectification is provided by a parallel combination circuit 51 of a capacitor and diode connected between primary winding 50 and ground.

As might be expected, increased current flow in the primary results in a high secondary voltage, thereby resulting in greater tube output intensity and/or a greater length of illumination of the tube. The output of comparator 46 is fed to a one-shot multivibrator that is controllable, that is, the on-time is controllable. This one-shot multivibrator 52 operates as an instant off, delay-on pulse generator with such pulses being utilized to regulate the switching waveforms for the switching device 24, which may comprise a bipolar NPN power transistor. It has been found that a current source rather than a voltage signal provides a more precise control for a bipolar transistor and, thus, a current-ramp, base-drive unit is utilized to convert the output of one-shot multivibrator 52 to current ramps that are used to control the base drive of the switching device 24. It is then seen that the provision of the switching device in the primary of high-voltage transformer 26 will control the output secondary current that is fed directly to the gas discharge tube being controlled. High-voltage transformer 26 is of the well-known step-up flyback type utilized to produce high voltages necessary to ionize the gas.

In the operation of the circuit of FIG. 2 and specifically in the analog section, the pulse-width modulated pulses are first compared on a DC basis with a ramp signal reflecting the actual current passing through the transformer primary 50, with the comparison results ultimately being, which are converted to ramps of current flowing through the primary winding 50 of transformer 26. Because a relationship exists between the pulse duration and the current ramp, that is, wider pulses will cause more current to flow through primary winding 50 of transformer 26, greater current flow will cause increased intensity and length of illumination because the secondary voltage increases.

By utilizing the overall system shown in FIG. 1 and specifically by entering desired lighting times and levels and illumination lengths using keypad unit 12, various lighting effects can be achieved by the digitally ionizable gas tube controller. For example, the length of illumination can be preselected and the level of intensity can be preselected so that the length can be set from any point from 0% to 100% of the full length of the gas discharge tube and also the intensity may be varied from 0 to 100% simply by using or making the appropriate adjustments in keypad unit 12 of FIG. 1. Because the present invention can operate in real time, as the light intensity level is adjusted, the gas discharge tube will display the selected level and permit the user to easily determine the effects of the changes that he has entered in the keypad unit.

Figure 3A:
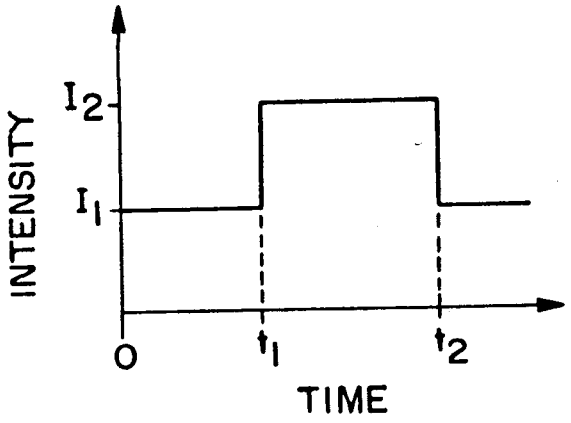
FIGS. 3A–3E are graphical representations of various operating modes of the inventive systems as shown in FIGS. 1 and 2.

In FIG. 3A, a graphical representation of a flashing mode is presented that will permit the use to program the lighting controller of FIG. 1 to permit two different levels of intensity, thereby providing a flashing effect. Thus, at time from time $t_0$ to time $t_1$, a first intensity level $I_1$ is obtained, whereas at a subsequent time from $t_1$ to $t_2$, an intensity level $I_2$ is obtained and then at time $t_2$ the intensity returns to $I_1$. Such control is easily obtained utilizing keypad unit 12 by entering the brightness levels and desired times of brightness.

Figure 3B:
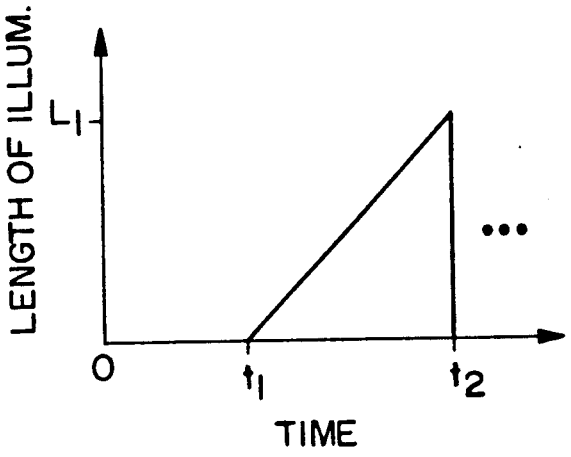

In FIG. 3B, and operating following the teaching of U.S. Pat. No. 4,742,278 a gas discharge tube may be gradually brought from a zero lighting length to any predefined length with the illumination then being abruptly turned off. This sequence would be subsequently repeated and, by using the system of FIG. 1, the user can set the duration of the off time as well as the length of time required to illuminate the tube, that is, the slope of the ramp, as well as the maximum intensity level that would be ultimately reached. Utilizing the operating mode of FIG. 3B will permit the user to sequentially write various letters.

Figure 3C:
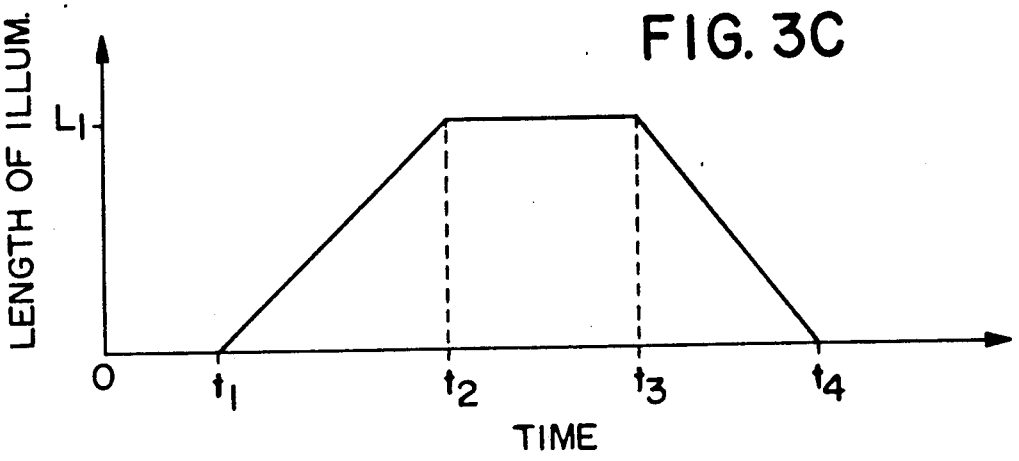

In FIG. 3C, an operating mode is represented that would permit both "writing" and "unwriting". In other words, from time $t_0$ to $t_1$, the sign or tube is not illuminated and at time $t_1$ it gradually becomes illuminated until time $t_2$, whereby it will remain on until time $t_3$ at which time it will then gradually recede back to a zero level of illumination or zero intensity. Utilizing the keypad unit 12 the user can independently control the time to bring the gas discharge tube to a maximum intensity, the time during which that maximum intensity may be held and the time required to extinguish the gas discharge tube to zero, as well as the time to hold such zero intensity, that is, the time during which the gas discharge tube is turned off.

Figure 3D:
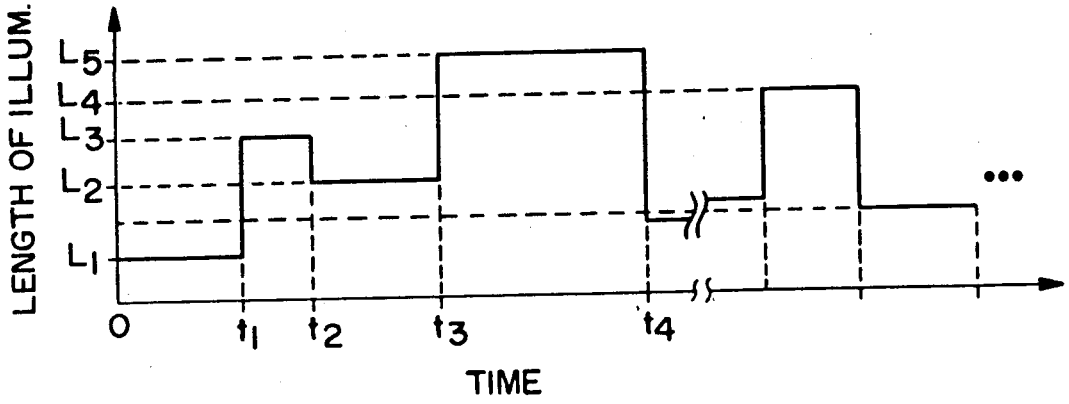

In the operating mode represented in FIG. 3D, the user is permitted to program steps of length of tube illumination and time duration, thereby creating what may be thought of lettering effects where the length of illumination increases and/or decreases along the length of the tube to individual letter boundaries. This will result in a display or sign in which the words can be sequentially spelled out.

Figure 3E:
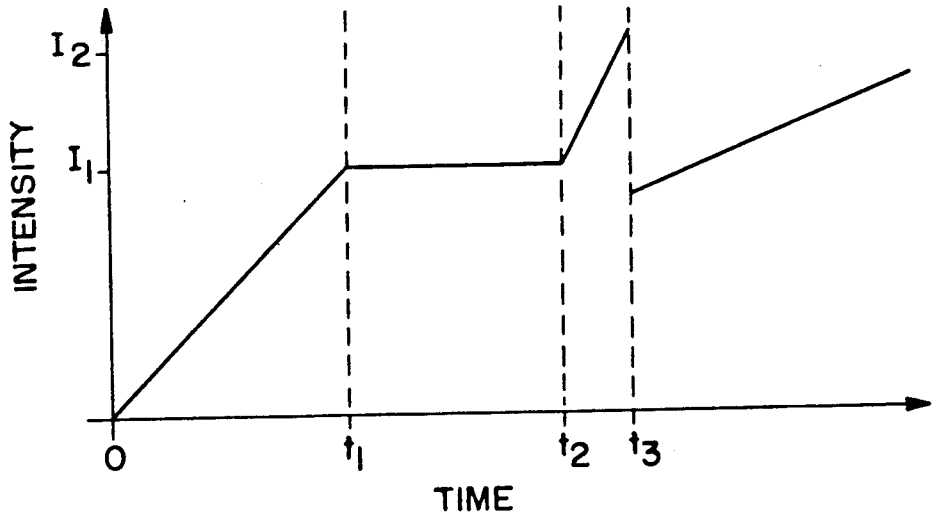

Finally, in FIG. 3E, a further operating mode is provided in which a varying sequence may be achieved utilizing keypad unit 12, in which the user can define the starting intensity or position along the length of the tube and the time required to ramp from the start to the finish. Thus, the user is permitted to program instructional steps allowing a wide variety of visual effects to be incorporated by simply entering times and desired intensities on keypad unit 12. For example, the user enters the time period $t_0$ and $t_1$ with an appropriate start level and start time and a time for $t_1$ and an end level intensity $I_1$. The time period extending from $t_1$ to $t_2$ is selected and a similar operation as in the first setting operation is accomplished for the time period from $t_2$ to $t_3$. Also, because digital control is provided, the lengths of illumination and intensity levels may be shifted from $I_2$ back to $I_1$ at time $t_3$ simply by entering the appropriate information on keypad unit 12.

The above description is given on a single preferred embodiment of the invention, but it will be apparent that many modifications and variations could be effected by one skilled in the art without departing from the spirit or scope of the novel concepts of the invention, which should be determined by the appended claims.

What is claimed is

1. A controller for a gas discharge tube, comprising:

a source of digital control signals representing at least an illumination length along a gas discharge tube and the output intensity thereof;

means receiving said digital control signals for providing pulse-width modulated signals therefrom;

analog drive circuit means receiving said pulse width modulated signals and producing a ramp pulse signal at a predetermined frequency;

energization means connected between a power source and the gas discharge tube and being controlled in response to said ramp pulse signal, whereby the length of illumination along the gas discharge tube and the output intensity thereof is controlled in response to said digital control signals.

2. A controller for a gas discharge tube according to claim 1, wherein said source of digital control signals comprises a manually actuatable keypad.

3. A controller for a gas discharge tube according to claim 1, further comprising a digital memory connected to store said digital control signals from said source for providing stored digital control signals to said means for providing pulse-width modulated signals.

4. A controller for a gas discharge tube according to claim 1, further comprising authorization means connected to said means for providing pulse-width modulated signals for selectively inhibiting operation thereof.

5. A controller for a gas discharge tube according to claim 1, wherein said energization means comprises a high-voltage fly-back transformer having a primary winding connected in series with a base-drive power transistor, a base lead of said transistor receiving said ramp pulse signal from said analog drive circuit means and the gas discharge tube being connected to a secondary winding of said transformer.

6. A controller for a gas discharge tube according to claim 1, wherein said analog drive circuit means comprises a digital-to-analog converter for converting said pulse-width modulated signal fed thereto to a voltage level signal varying in accordance with the information contained in said pulse-width modulated signal, a comparator means for comparing said varying voltage level signal with a signal representing an energization voltage in said energization means, whereby the result of the comparison is employed for producing said ramp pulse signal fed to said energization means.

7. A controller for a gas discharge tube according to claim 6, wherein said energization means comprises a transformer having a primary winding connected in series with a base-drive transistor and said ramp pulse signal is fed to a base lead of said transistor.

8. A controller for a gas discharge tube according to claim 7, wherein said analog drive circuit means further comprises a one-shot multivibrator connected to an output of said comparator means for producing pulses therefrom having a selectable pulse width and a current ramp circuit for producing from said pulses from said one-shot multivibrator said ramp pulse signals fed to said base lead of said transistor.

9. A controller for a gas discharge tube according to claim 8, wherein said analog drive circuit means further comprises current sensor means connected between said transistor and ground for sensing the current flowing in said primary winding of said transformer.

10. A controller for a gas discharge tube according to claim 9, wherein said digital-to-analog converter comprises a low-pass filter.

* * * * *